US005551330A

United States Patent [19]

Reuche

[11] Patent Number: 5,551,330

[45] Date of Patent: Sep. 3, 1996

[54] DISPERSIBLE COUNTERMASS SYSTEM FOR A RECOILLESS WEAPON

[75] Inventor: Marc Reuche, La Chapelle Saint Ursin, France

[73] Assignee: Luchaire Defense SA, Versailles, France

[21] Appl. No.: 359,607

[22] Filed: Dec. 20, 1994

[30] Foreign Application Priority Data

Dec. 22, 1993 [FR] France ..... 93 15418

[51] Int. Cl.[6] ..... F41A 1/08

[52] U.S. Cl. ..... 89/1.701

[58] Field of Search ..... 89/1.701, 1.702

[56] References Cited

U.S. PATENT DOCUMENTS

| | | | |
|---|---|---|---|
| 3,796,128 | 3/1974 | Zeyher | 89/1.701 |
| 3,800,656 | 4/1974 | Schnäbele | 89/1.701 |
| 3,815,469 | 6/1974 | Schubert et al. | 89/1.701 |
| 4,050,351 | 9/1977 | Stauff | 89/1.701 |
| 4,132,148 | 1/1979 | Meistring et al. | 89/1.701 |
| 4,172,420 | 10/1979 | Voss et al. | 89/1.701 |
| 5,337,648 | 8/1994 | Brage | 89/1.701 |
| 5,370,032 | 12/1994 | Reuche et al. | 89/1.701 |

FOREIGN PATENT DOCUMENTS

| | | | |
|---|---|---|---|
| 0100722 | 2/1984 | European Pat. Off. | 89/1.701 |
| 1169173 | 12/1958 | France . | |
| 2194940 | 3/1974 | France . | |
| 309598 | 9/1955 | Switzerland . | |
| 1291336 | 10/1972 | United Kingdom . | |
| WO92/06344 | 4/1992 | WIPO . | |

*Primary Examiner*—Michael J. Carone
*Assistant Examiner*—Theresa M. Wesson
*Attorney, Agent, or Firm*—Bell, Seltzer, Park & Gibson, P.A.

[57] ABSTRACT

A dispersible countermass system for a recoilless weapon, designed to be installed in a weapon barrel and to be ejected on firing through a rear portion thereof by a piston driven by the pressure of the combustion gases of a propellant charge while a projectile is simultaneously being launched towards the front portion of the barrel, the system comprising a charge of dispersible and inert matter disposed inside a case that is closed by a cover and by an end, wherein the case is formed by a cylindrical wall that fits inside the barrel and that is prevented from moving in translation relative thereto, and wherein the cover is connected to the case via connection means that are ruptured by the piston on firing, the case serving to guide the piston which has a peripheral rim that remains in contact with the case so as to provide sealing for the gases, the piston thus serving to eject the inert matter from the barrel.

16 Claims, 7 Drawing Sheets

DISPERSIBLE COUNTERMASS SYSTEM FOR A RECOILLESS WEAPON

The technical field of the invention is that of countermasses for recoilless weapons.

BACKGROUND OF THE INVENTION

Such countermasses, also known as reaction masses, comprise a charge of inert matter designed to balance momentum during firing, thereby eliminating recoil. To do this, a countermass is ejected backwards from the weapon by a propellant charge at the same time as a projectile is launched forwards.

The countermasses generally in use are constituted by solids that fragment on leaving the barrel of the weapon, which solids may be implemented, for example, in the form of a bundle of filaments of a plastics material.

A drawback presented by that type of countermass is that it gives rise to significant danger behind the weapon both for the person firing it and also for friendly troops.

Various solutions have been proposed for that problem. In particular the nature of the matter constituting the countermass has been optimized by reducing it to the form of a powder, granules, or the like.

However that requires the use of a container, as described in French patent FR-2 356 904.

The problem then arises of behind-weapon safety when the container bursts on leaving the barrel of the weapon.

There is also the problem of sealing between the piston that ejects the countermass and the barrel. When a shot is fired, the container, which is generally made of a prestressed material such as glass, breaks up into small pieces. These highly abrasive pieces of glass can become engaged between the piston and the barrel, thereby spoiling the sealing of the system and giving rise to leaks that are harmful to proper operation of the weapon.

OBJECT AND SUMMARY OF THE INVENTION

The object of the invention is to provide a countermass system that enables such drawbacks to be mitigated.

The invention thus provides a dispersible countermass system for a recoilless weapon, the system being designed to be installed in a weapon barrel and to be ejected on firing through a rear portion thereof by means of a piston that is driven by the pressure of the combustion gases of a propellant charge while a projectile is simultaneously being launched towards the front portion of the barrel. The system, comprises a charge of dispersible and inert matter disposed inside a case that is closed by a cover and by an end, wherein the case is formed by a cylindrical wall that fits inside the barrel and that is prevented from moving in translation relative thereto, and wherein the cover is connected to the case via connection means that are ruptured by the piston on firing, the case serving to guide the piston which has a peripheral rim that remains in contact with the case so as to provide sealing for the gases, the piston thus serving to eject the inert matter from the barrel.

The end may be formed by the piston itself or by a partition connected to the case by link means that are broken by the piston on firing.

Preferably, the cylindrical wall and the partition form a single part, with the partition including at least one line of weakness defined by the wall.

According to other characteristics, the cover is connected to the case by adhesive and the cylindrical wall has a rearward extension co-operating with the partition to form a piston-receiving cup.

The charge of inert matter is a liquid made up of water and an antifreeze agent such as calcium chloride.

The material constituting the wall, the partition, and the cover is a plastics material of the polyphenylene oxide type.

In a variant embodiment, the cylindrical wall is installed in a larger-diameter portion formed in the rear portion of the barrel, which larger-diameter portion has a diameter such that the inside diameter of the wall installed in the barrel is equal to the inside diameter for guiding the projectile at the front end of the barrel, and the end of the rearward extension of the wall bears against a shoulder of the barrel, which shoulder interconnects the larger-diameter portion with the portion for guiding the projectile guiding portion.

In a preferred embodiment, the cylindrical wall is made up of three lengths that are secured to one another.

The cylindrical wall may be extended to the rear portion of the barrel by a spacer prevented from moving in translation relative thereto and having the same inside diameter as the wall.

The spacer serves to ensure that the wall and the weapon barrel are prevented from moving in translation relative to each other.

According to other characteristics, the cover is in the form of a cone converging towards the rear portion of the weapons barrel, and including a filling orifice fitted with a closure screw and with a sealing washer.

preferably, the cover has a wall that is corrugated, enabling it to accommodate expansion of the liquid caused by variations in temperature.

The piston includes a sealing device preventing any leakage of the inert matter. In a first variant, the sealing device comprises a lip that is put into contact with the case by the pressure of the inert matter during firing, thereby enabling dynamic sealing to be provided. It may also comprise a gasket disposed in a groove formed in the outside diameter of the piston and serving to provide both dynamic and static sealing.

BRIEF DESCRIPTION OF THE DRAWINGS

The invention will be better understood on reading the following description of particular embodiments that is given with reference to the accompanying drawings, in which.

MORE DETAILED DESCRIPTION

Figure 1:
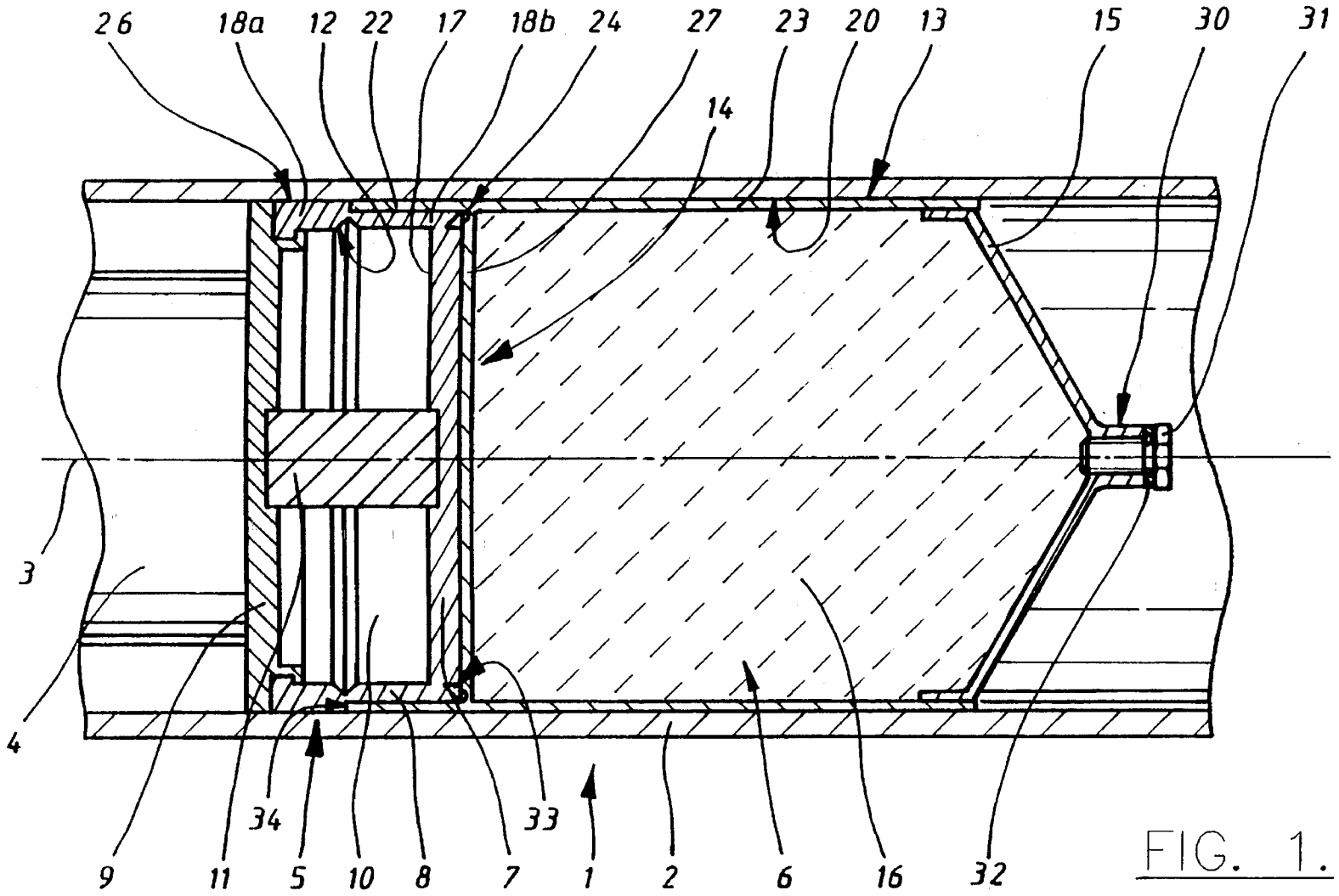
FIG. 1 is a section view through a recoilless weapon that includes a countermass constituting a first embodiment of the invention.

With reference to FIG. 1, the middle portion of a recoilless weapon 1 is shown diagrammatically and in section. The weapon comprises a cylindrical barrel 2 about an axis 3 made, for example, by winding a filamentary material. Inside the barrel there are disposed a projectile 4, a housing 5 containing a propellant charge, and a dispersible countermass 6.

The back portion of the projectile 4 carries fins (not shown) for stabilization purposes. Inside the barrel 2 they are folded along the body of the projectile, and they are deployed once the projectile has left the barrel.

The housing 5 has a front wall 9 plus a tubular wall 8 that is closed by a rear wall 7 that is integral therewith.

The tubular wall 8, the rear wall 7, and the front wall 9 define an internal volume 10 designed to receive a propellant charge of known type of the single base or of the double base flake powder kind.

A black powder igniter 11 of known type is also disposed in the inside volume 10, on the axis 3. It is connected by wires to a firing device for the weapon.

The middle portion of the tubular wall 8 has an annular line of weakness 12 of triangular section designed to split the housing into two pistons, as explained below. One such housing is described in French patent FR 92 12 643.

The countermass 6 comprises a case 13, an end 14, and a cover 15, which together define an internal volume that is filled with an inert matter 16. The case 13 is constituted by a cylindrical wall 23 that fits the inside diameter 20 of the barrel 2 and that is prevented from moving in translation relative thereto, e.g. by adhesive. The end 14 is constituted by a partition 27. The cylindrical wall 23 and the partition 27 are integral, and the boundary between them is marked by a line of weakness 24 designed to facilitate separation thereof.

The cover 15 closes the rear portion of the wall to define an inside volume that is filled with the inert matter 16. It is conical in shape, converging towards the rear of the weapon, and in its center it has a filling orifice 30 fitted with a closure screw 31 and a sealing washer 32. Such a disposition facilitates filling with inert matter, and in particular it facilitates evacuation of air. The cover may be secured to the case by adhesive, for example.

The wall 23, the partition 27, and the cover 15 are made of a low density plastics material, e.g. having relative density lying in the range 0.9 to 1.2. The material may be constituted, for example, by polyphenylene oxide sold under the registered trademark "Noryl".

The inert filler matter of the countermass is a liquid, e.g. water optionally including antifreeze such as calcium chloride. The addition of calcium chloride makes it possible to use the weapon at temperatures below 0°C. In addition, its relatively high density makes it possible to reduce the volume of the countermass. The calcium chloride preferably represents about 30% of the mass.

Beyond the partition 27, the wall 23 has a rearward extension 22 which forms a cup 17. The cup is designed to receive a portion of the housing 5. At its projectile end, the housing has an enlarged portion 26 whose outside diameter is substantially the same as the inside diameter 20 of the barrel 2.

The housing 5 is slidably mounted in the barrel 2 and the cylindrical wall 23, and it bears against the partition 27. Preferably, it has a low coefficient of friction lying in the range 0.15 to 0.25 and it made of a plastics material of the polyethylene kind.

In its rear wall 7, the housing 5 has an annular groove 33 of triangular section machined therein for a purpose that is explained below.

The countermass of the invention operates as follows:

When the igniter 11 is ignited, it in turn ignites the propellant charge which fills the inside volume 10. The increasing pressure inside the housing 5 has the effect of separating the housing into two portions referred to below as "pistons" **18*a* and 18*b*, with the portions separating at the line of weakness 12**.

Advantageously, the line of weakness 12 is situated in the zone where the wall of the housing has its smallest thickness, and level with an end 34 of the rearward extension 22 of the wall 23, with the length of the piston **18*b* being substantially equal to the length of the rearward extension 22**.

Figure 2:
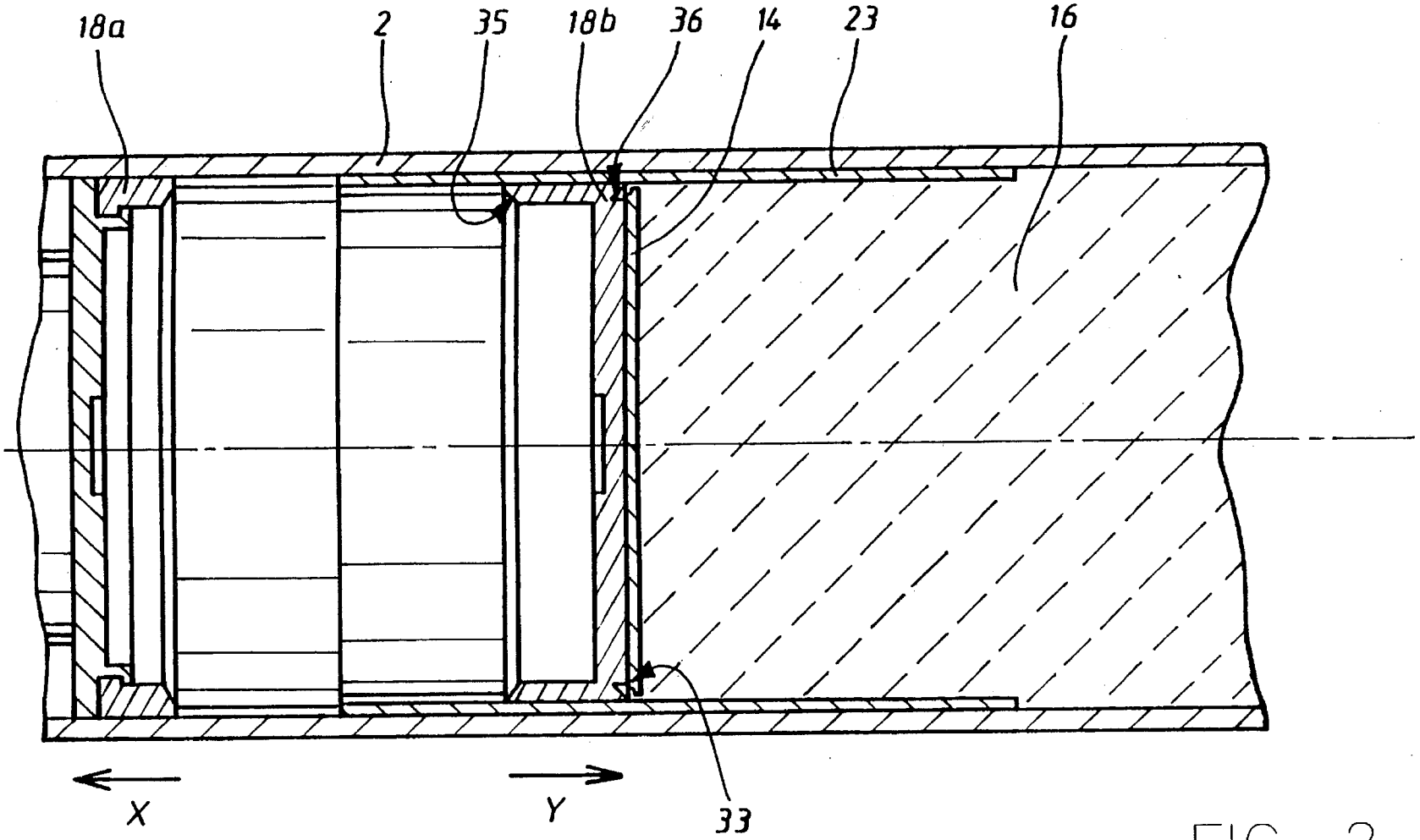
FIG. 2 is a view analogous to FIG. 1 showing the countermass after the propellant charge has been fired.

FIG. 2 shows the weapon at the instant of separation.

The igniter is not shown since its component parts have already been fragmented by the pressure.

The pressure of the gases acts via the piston **18*a*** to drive the projectile towards the front of the weapon in direction X.

The pressure exerted on the piston **18*b* has the effect of separating the partition 27 from the cylindrical wall 23 of the countermass at the line of weakness 24. The pressure imparted to the liquid 16 via the piston breaks the cover 15 into small fragments. The liquid 16** is driven towards the rear of the weapon in direction Y.

The wall 23 serves to guide the piston **18*b* which has a conical peripheral rim 35 derived from the line of weakness 12** that remains in contact with the wall under the pressure generated by the combustion gases of the charge, thereby ensuring gas sealing (see French patent FR 92 12 643 which describes such a piston).

The pressure of the combustion gases drives the piston **18*b* against the cylindrical wall 23, thereby thrusting it into closer contact with the barrel 2**.

The rise in the pressure of the inert matter that takes place when the shot is fired serves to ensure sealing of the inert matter by contact between the lip 36 of the annular groove 33 bearing against the cylindrical wall 23.

Under the effect of its high ejection speed, the liquid is vaporized into fine droplets on leaving the barrel of the weapon.

Only the two walls making up the countermass are ejected as rearward projections, namely the partition 27 and the cover 15. The cylindrical wall 23 remains secured to the barrel. Since these projections are made of a low density material and are of small thickness (about 1 mm to 2 mm), the danger behind is minimized.

Figure 3:
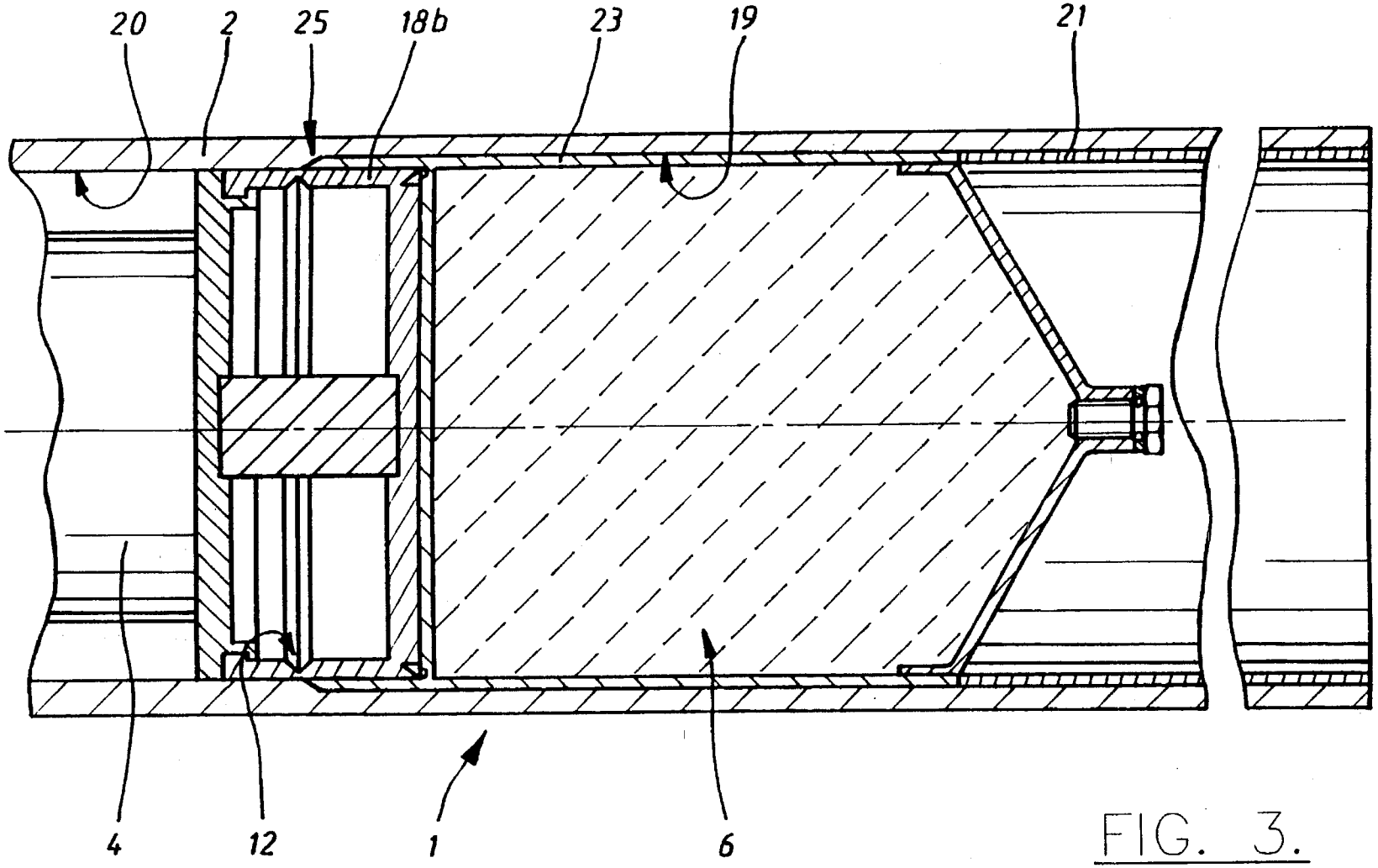
FIG. 3 shows a second embodiment of a countermass of the invention.

FIG. 3 shows a second embodiment of the countermass of the invention.

As in the preceding embodiment, a recoilless weapon 1 comprises a barrel 2 containing a projectile 4, a housing 5 that contains a propellant charge, and a countermass 6.

In this embodiment, the barrel 2 has two different inside diameters 19 and 20 that join each other via a shoulder 25. The inside diameter 20 for guiding the projectile is smaller than the diameter 19 situated in the rear portion of the barrel 2.

The cylindrical wall 23 of the countermass 6 is secured to the barrel 2 in the larger diameter portion 19, e.g. by adhesive, with the end of the rearward extension 22 of the wall bearing against the shoulder 25. The inside diameter of the cylindrical wall 23 is equal to the inside diameter 20 of the barrel.

This variant facilities manufacture of the housing 5 which now has only one outside guide diameter for co-operating with the barrel 2 and with the wall 23. The housing is slidably guided within the cylindrical wall of the barrel.

In this embodiment, the wall 23 is extended to the rear portion of the barrel within the larger diameter portion 19 by a spacer 21. The spacer has the same inside diameter as the wall and it is secured to the barrel in its larger diameter portion 19, e.g. by adhesive.

The spacer 21 improves the resistance of the wall against displacement in translation relative to the barrel, and consequently holds the countermass more securely.

In a variant, the wall 23 can be secured solely by the spacer 21 which is stuck to the larger-diameter portion 19 of the barrel 2 by adhesive.

Figure 4:
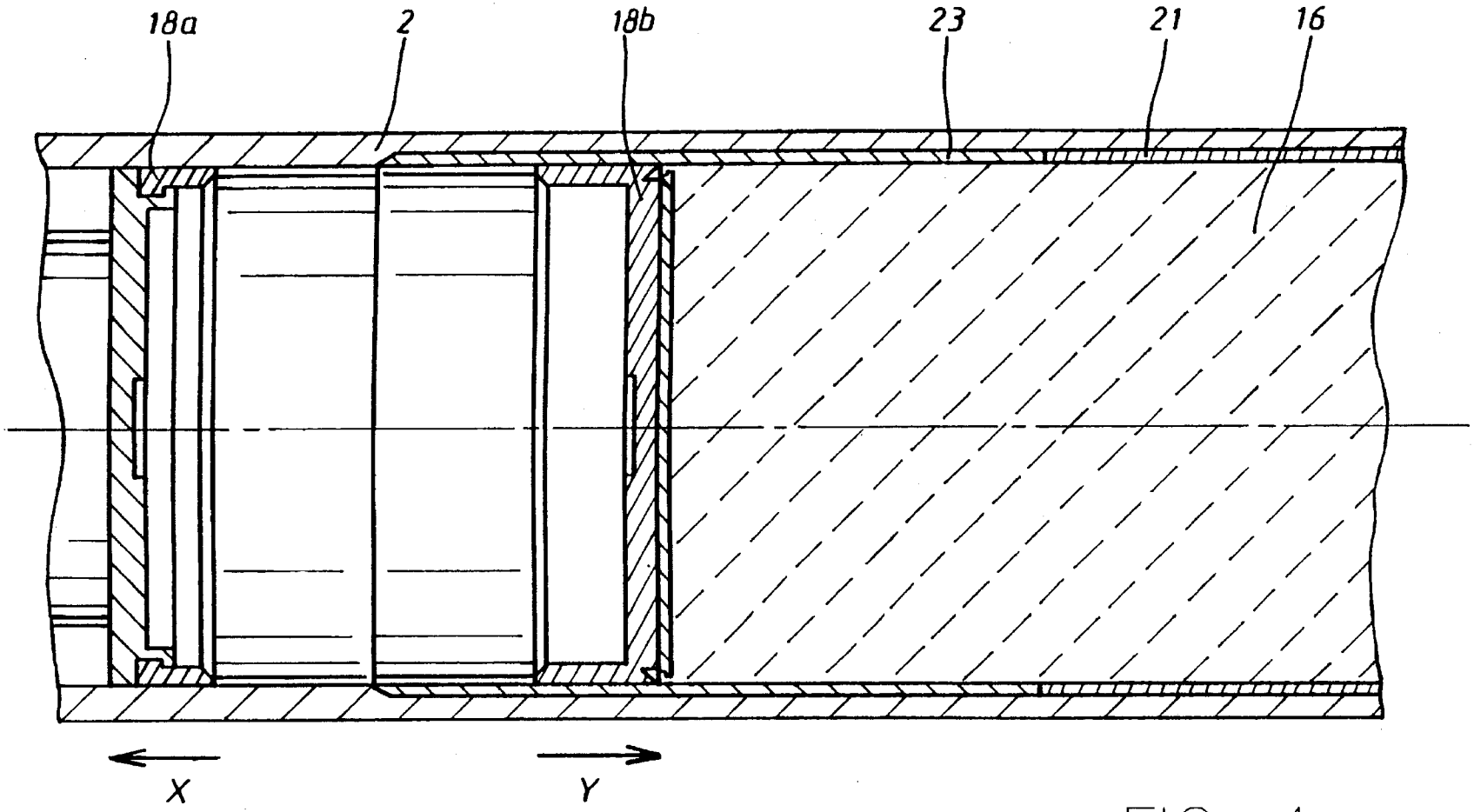
FIG. 4 is a view analogous to FIG. 3 showing the countermass after the propellant charge has been fired.

FIG. 4 shows the weapon at the moment when the housing splits into two pistons after the propellant charge has ignited.

The pressure of the gases drives the projectile in the direction X via the piston 18*a*, and the countermass 6 in the direction Y via the piston 18*b*.

In this variant, the piston 18*b* is guided and sealing is achieved between the propellant charge and the liquid of the countermass all the way to the rear end of the weapon barrel by the spacer 21 whose inside diameter is equal to the inside diameter of the cylindrical wall 23.

In a variant, it would naturally be possible to make a case for the countermass that possesses a cover 15 and a cylindrical wall 23 that are integral with each other, and a partition 27 secured to the wall, e.g. by adhesive or by ultrasonic welding. The wall, the cover and the partition may also be made as a single piece by molding or by blowing.

It is also possible to envisage having a piston that is in the form of a hollow punch so as to ensure or improve separation between the partition and the wall of the countermass under drive from the piston on firing.

It is also possible to make the cylindrical wall from a plurality of elements that are secured to one another, e.g. by adhesive.

Figure 5:
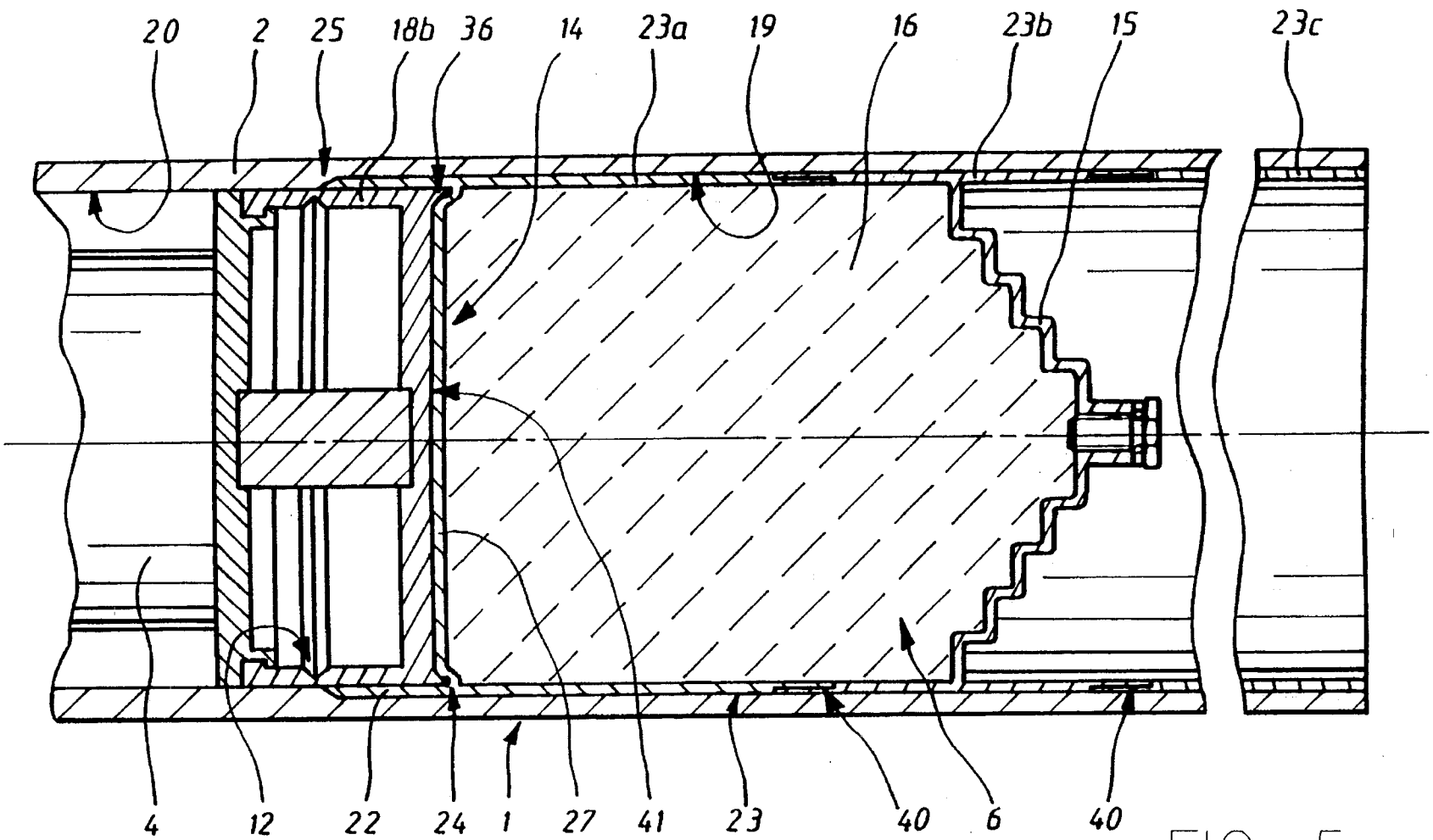
FIG. 5 shows a third embodiment of a countermass of the invention.

FIG. 5 shows a third embodiment of the countermass of the invention.

As in the preceding embodiment, a recoilless weapon 1 has a barrel 2 containing a projectile 4, a housing 5 which contains a propellant charge, and a countermass 6.

In this embodiment, the countermass 6 forms a subassembly that can be secured to the larger diameter portion 19 of the barrel 2, e.g. by adhesive.

The cylindrical wall 23 of the countermass is made up of three lengths 23*a*, 23*b*, and 23*c* that are secured to one another, e.g. by adhesive, via complementary-shaped portions 40 of reduced thickness formed on each of the three lengths.

The rearward extension 22 of the length 23*a* comes into abutment against the shoulder 25 of the barrel 2. The end 14 is constituted by a partition 27 that is integral with the length 23*a*. The partition 27 has a line of weakness 24 designed to facilitate separation thereof from the cylindrical wall 23.

In this embodiment, the partition fits closely around the piston 18*b* which has an internal cup 41 and an annular lip 36 around its outside diameter.

The length 23*b* of the wall 23 is secured to the cover 15 and is integral therewith. The cover has a stepped or corrugated wall enabling it to accommodate variations in the volume of the liquid 16, which expansions can occur because of temperature variations.

The length 23*c* of the wall 23 extends as far as the rear portion of the barrel, but in a variant it is possible to have a length 23*c* that is shorter and that is extended by a spacer to the rear portion of the barrel, which spacer has the same inside diameter as the cylindrical wall 23.

This variant embodiment serves, in particular, to make a countermass in the form of a complete subassembly, after the lengths 23*a*, 23*b*, and 23*c* have been assembled together, which subassembly can be inserted inside the weapon barrel and prevented from moving in translation relative thereto.

Figure 6:
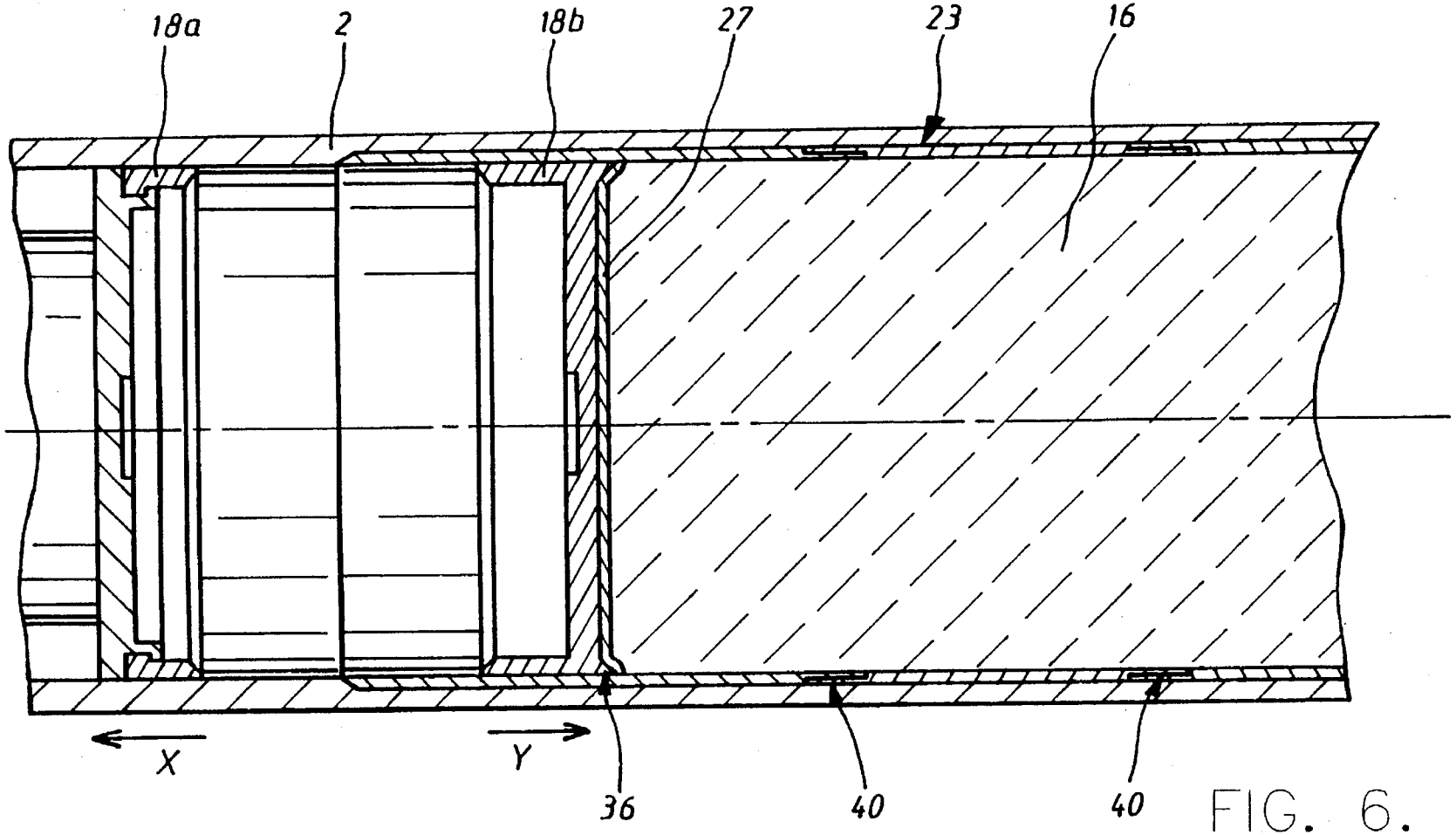
FIG. 6 is a view analogous to FIG. 5 showing the countermass after the propellant charge has been fired.

FIG. 6 shows the weapon at the moment after the propellant charge has been ignited when the housing splits into two pistons.

The pressure of the gases drives the projectile in the direction X via the piston 18*a* and the countermass 6 in the direction Y via the piston 18*b*.

In this embodiment, sealing between the piston 18*b* and the liquid of the countermass is provided by the annular lip 36 which, as the pressure in the liquid rises after the shot has been fired, comes into contact with the cylindrical wall 23. This sealing is further improved in this case by the partition 27 likewise having a lip (after the line of weakness has broken) that comes to bear against the walls of the case.

In a variant, in order to reduce friction and eliminate any danger of the cylindrical wall 23 being torn off by the lip 36 of the piston 18*b* as it moves through the lengths 23*a*, 23*b*, and 23*c*, it is possible to make these portions with a different inside diameter. For example, the length 23*c* could have an inside diameter that is slightly greater than the inside diameter of the preceding length 23*b* which in turn could have a diameter that is slightly greater than the inside diameter of the length 23*a*. The differences of diameter should be very small, of the order of a few tenths of a millimeter, thereby ensuring that sealing is always achieved because of the ability of the lip 36 and of the partition 27 to deform by more than the changes in inside diameter. In a variant, it would naturally be possible to make a cylindrical wall that is very slightly conical with respect to inside diameter, the largest diameter end being part of the length 23*c* and situated towards the rear end of the weapon barrel.

To facilitate implementation, it is naturally possible to make the cylindrical wall 23 as one length only or as two lengths, the lengths 23*b* and 23*c* being previously assembled together so as to constitute a single length.

Figure 7:
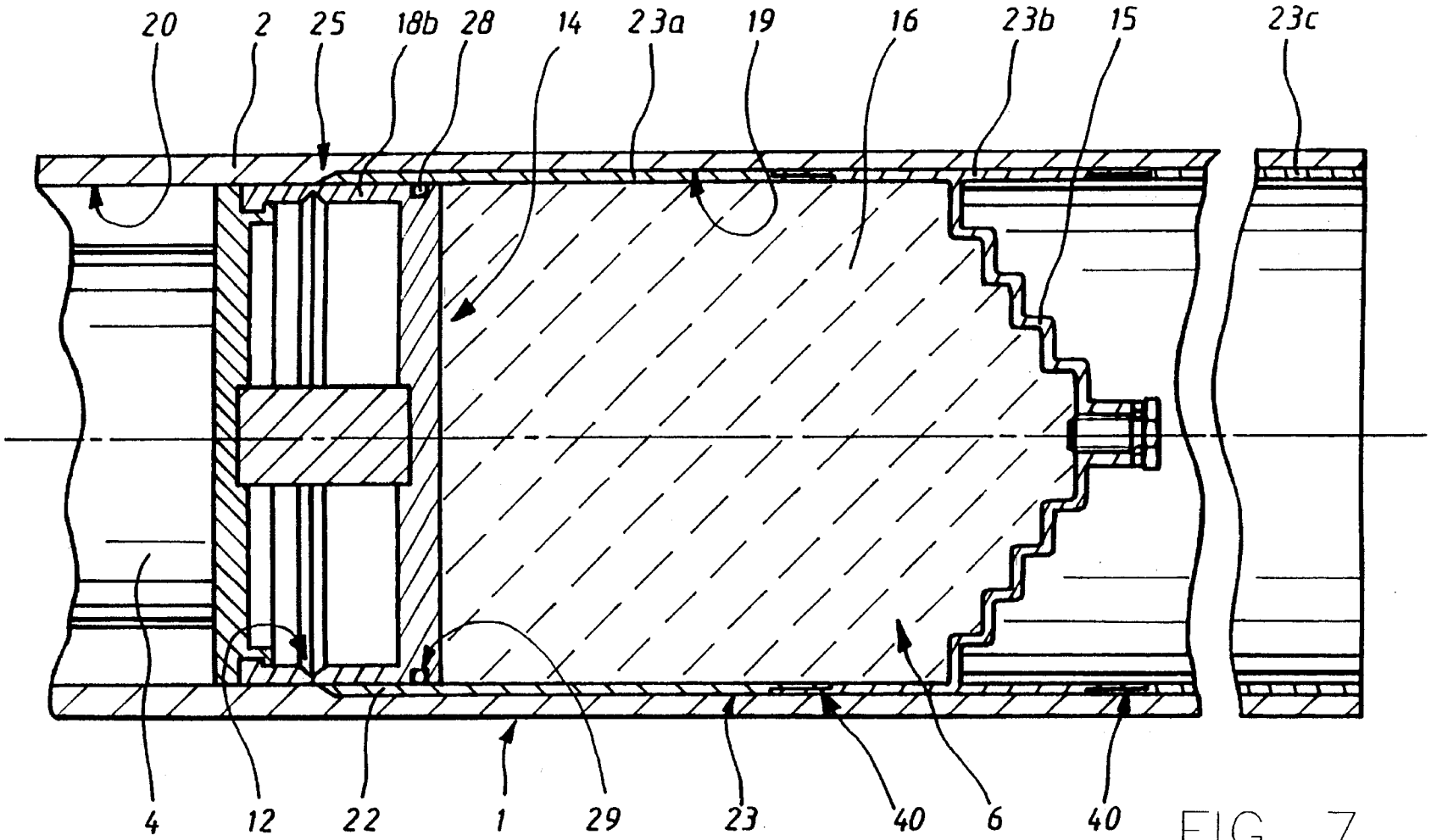
FIG. 7 shows a variant embodiment of the countermass of the invention.

FIG. 7 shows a variant embodiment of the countermass of the invention.

In this variant, the end 14 is constituted by the piston 18*b* itself.

Sealing against the inert matter between the piston 18*b* and the cylindrical wall 23 is provided by means of a gasket 28 disposed in a circular groove 29 formed in the outside wall of the piston 18*b*. Such a device serves to provide both static and dynamic sealing.

This embodiment makes it possible to reduce the number of parts required for making the countermass, and also to reduce the quantity of rearward projections.

The piston can be secured to the case, e.g. by a few spots of adhesive.

I claim:

1. A dispersible countermass system for a recoilless weapon, designed to be installed in a weapon barrel and to be ejected on firing through a rear portion thereof by a piston driven by pressure of the combustion gases of a propellant charge while a projectile is simultaneously being launched towards the front portion of the barrel, the system comprising a charge of dispersible and inert matter disposed inside a case that is closed by a cover and by an end, wherein the case is formed by a cylindrical wall that fits inside the barrel and that is prevented from moving in translation relative thereto, wherein the end of the case is formed by a partition connected to the case by connection means, wherein the cover is connected to the case via connection means, and wherein the connection means of the end and the cover to the case are ruptured by the piston on firing, the case serving to guide the piston which has a peripheral rim that remains in contact with the case so as to provide sealing for the gases, the piston thus serving to eject the inert matter from the barrel.

2. A countermass system according to claim 1, wherein the cylindrical wall and the partition are formed integrally with each other, the partition including at least one line of weakness defined by the wall.

3. A countermass system according to claim 1, wherein the cover is connected to the case by adhesive.

4. A countermass system according to claim 1, wherein the cylindrical wall has a rearward extension co-operating with the partition to form a cup in which the piston is received.

5. A countermass system according to claim 4, wherein the cylindrical wall is installed in a larger diameter portion formed in a rear portion of the barrel, wherein the larger diameter portion has a diameter such that the diameter of the cylindrical wall installed in the barrel is equal to the cylindrical wall diameter for guiding the projectile at the front end of the barrel, and wherein the end of the rearward extension of the wall bears against a shoulder of the barrel, which shoulder interconnects the larger diameter portion with the portion for guiding a projectile guiding portion.

6. A countermass system according to claim 1, wherein the charge of inert matter is a liquid made up of water and an antifreeze agent.

7. A countermass system according to claim 6, wherein the antifreeze agent is calcium chloride.

8. A countermass system according to claim 1, wherein the material constituting the wall, the partition, and the cover is a polyphenylene oxide plastics material.

9. A countermass system according to claim 1, wherein the cylindrical wall is made up of three lengths that are secured to one another.

10. A countermass system according to claim 1, wherein the cylindrical wall is extended to the rear portion of the barrel by a spacer prevented from moving in translation relative thereto and having the same diameter as the wall.

11. A countermass system according to claim 10, wherein the spacer serves to ensure that the wall and the weapon barrel are prevented from moving in translation relative to each other.

12. A countermass system according to claim 1, wherein the cover is in the form of a cone converging towards the rear portion of the weapons barrel, and including a filling orifice fitted with a closure screw and with a sealing washer.

13. A countermass system according to claim 12, wherein the cover has a wall that is corrugated, enabling it to accommodate expansion of the liquid caused by variations in temperature.

14. A countermass system according to claim 1, wherein the piston includes a sealing device preventing any leakage of the inert matter.

15. A countermass system according to claim 14, wherein the inert matter sealing device of the piston comprises a lip put into contact with the case by the pressure of the inert matter on firing, and enabling dynamic sealing to be provided.

16. A countermass system according to claim 14, wherein the inert matter sealing device of the piston comprises a gasket disposed in a groove formed in the outside diameter of the piston, and enabling both dynamic and static sealing to be provided.

* * * * *